United States Patent [19]

Skimin

[11] 4,405,413

[45] Sep. 20, 1983

[54] BLUSH-FREE ACID ZINC ELECTROPLATING BATHS AND PROCESS

[75] Inventor: Carol W. Skimin, Mayfield Hts., Ohio

[73] Assignee: The Harshaw Chemical Company, Cleveland, Ohio

[21] Appl. No.: 379,833

[22] Filed: May 20, 1982

[51] Int. Cl.[3] ..... C25D 3/22

[52] U.S. Cl. ..... 204/55 R

[58] Field of Search ..... 204/55 R, 55 Y, 43 Z, 204/114

[56] References Cited

U.S. PATENT DOCUMENTS

| | | | |
|---|---|---|---|
| 3,909,374 | 9/1975 | Skimin | 204/55 R |
| 4,070,256 | 1/1978 | Hsu et al. | 204/55 R |
| 4,146,441 | 3/1979 | Willis | 204/55 R |
| 4,226,682 | 10/1980 | Popescu | 204/55 R |
| 4,229,268 | 10/1980 | Lowery et al. | 204/55 R |

*Primary Examiner*—G. L. Kaplan

*Attorney, Agent, or Firm*—James A. Lucas

[57] ABSTRACT

A bright acid zinc plating bath uses a surfactant or wetting agent having the general formula $C_nH_{2n+1}(OCH_2CH_2)_x OCH_2COOH$ wherein n is either 8 or 9, and wherein between 30 and 70% of the surfactant contains between 17 and about 21 ethylene oxide groups and 70–30% contains between about 9 and about 12 ethylene oxide groups. When used with organic brighteners, the blend of surfactants permits the electrodeposition of a bright layer which resists the formation of haze or blush which can occur when a plated part is flexed or is subjected to elevated temperatures encountered, e.g., upon curing of a protective lacquer coating.

4 Claims, No Drawings

BLUSH-FREE ACID ZINC ELECTROPLATING BATHS AND PROCESS

BACKGROUND OF THE INVENTION

1. Field of the Invention

This invention relates to the electrodeposition of zinc from an acid plating bath. Particularly, it relates to the plating of substrates which are then coated with a lacquer. The bath is formulated to eliminate blush which normally occurs when the plated substrate is subjected to bending stress or to elevated temperatures encountered for instance, when the lacquer is baked.

2. Discussion of the Prior Art

There are a number of commercially available acid zinc electroplating baths such as zinc sulfate, zinc chloride, zinc fluoroborate and pyrophosphate. The zinc plating bath typically includes a buffer such as an ammonium salt, one or more ductilizers, along with brighteners and other additives to improve throwing power and covering power. Suitable surfactants have included compounds such as polyalkylated napthols (U.S. Pat. No. 4,146,441 and U.S. Pat. No. 4,229,268); and alkoxylated alkyl phenols (U.S. Pat. No. 4,226,682, U.S. Pat. No. 4,070,256, U.S. Pat. No. 3,787,297).

A specialized application for acid zinc baths is the plating of shelves and other steel parts used inside of refrigerators. For appearance, the zinc layer must be bright and shiny. After plating, the parts normally are chromated and then are coated with a protective layer of a lacquer which is then baked by heating to an elevated temperature. Often this baking causes the zinc layer to become dull and hazy, a trait that is referred to as blush. The appearance of blush on the plated parts is a basis for the customer to reject the parts as unsatisfactory.

Prior attempts to correct the blush problem have not been successful. Repeated attempts at isolating the problem led to the conclusion that the lacquer was not the cause of the problem but that the surfactant in the plating bath was a major contributor to the thermally induced haze.

Often a part that undergoes flexing or bending after zinc plating likewise develops a haze and becomes dull and unattractive. Again, the problem appears to be related to the type and nature of surfactant used in the plating bath.

The development of a haze is particularly noticeable on parts that are plated at current densities above 14 or 15 amps per square foot, using steady or interrupted current. The haze is relatively independent of the nature or type of agitation, as well as the pH and the temperature of the bath.

The blush problem has been noted in a number of commercially available acid zinc plating baths, notably those that use ammonium or potassium salt as the source of zinc ions.

SUMMARY OF THE INVENTION

The present invention describes an acid zinc plating bath which will give a deposit having decreased susceptibility to blush. The invention covers an acid zinc plating bath and a process of electrodepositing a layer of zinc therefrom, involving the use of a surfactant which prevents the development of undesirable blush when the plated part is subjected to bending or is baked at elevated temperatures.

A particularly satisfactory surfactant comprises a blend of at least two carboxy-terminated long chain alkyl phenols. One of the phenols contains between about 9 and about 12 ethylene oxide groups while the other phenol contains between about 17 and about 21 ethylene oxide groups.

DETAILED DESCRIPTION OF THE INVENTION

The present invention comprises the use of a surfactant in an acid zinc plating bath wherein the surfactant is composed of a carboxy-terminated ethylene oxide adduct of a long chain alkyl phenol having the general formula

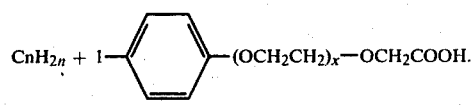

The mixture of surfactants is present in the bath in an amount of between 5 and 25 g/l.

The formation of post-bake or bending haze is minimized by using a blend of at least two species of the surfactant, the first having between about 9 and 12 ethoxy groups in the chain and the second having between about 17 and 21 ethoxy groups. The average ethoxylation number of the lower molecular weight moiety typically is 11.5 while the number for the higher molecular weight moiety is approximately 19. In the formula n is either 8 or 9. These surfactants may be purchased from Chem Y Fabriek van Chemische Producted, N.V. as Akypo OP 115 and Akypo OP 190. The relative ratio of the two surfactants in the blend is between about 30 to 70% and 70 to 30%.

The lower molecular weight surfactant in which x is between 9 and 12 is useful primarily for its ability to prevent haze and blush under the adverse conditions incurred when a plated part is subjected to bending or baking at elevated temperatures. However, this surfactant is not a good solubilizer for the organic brighteners that are used in the plating bath. The surfactant in which x is between 17 and 21 is a strong solubilizer thus serving to keep the organic brighteners in solution. This second surfactant tends to cause the formation of blush and haze in the deposit. Unexpectedly, the mixture of approximately equal amounts of the two surfactants synergistically achieves what neither is able to do by itself, that is, help produce a fully bright zinc electrodeposit which is tolerant of the high temperatures used to bake the lacquer and to bending and flexing of the plated part.

The invention is effectively used in a variety of aqueous bright acid zinc plating baths including zinc sulfate, zinc chloride, zinc pyrophosphate and zinc fluoborate. The zinc salt is present in an amount that is adequate to supply between about 6 and about 60 g/l of zinc metal in solution.

The bath contains one or more organic brighteners selected from the group including acetothionaphthene, furfural acetone, benzalacetone, benzophenone, benzol acetonitrile and orthochlorobenzaldehyde. When used in an amount of between 0.1 and 2 g/l, they impart peak brightness over the entire surface of the deposit.

Carriers are used in the bath to improve levelling and texture of the deposit over a wide range of current densities and temperatures and are selected from the groups which include aliphatic diketones, dialdehydes, certain heterocyclic compounds, coffee derivatives and coumarin and its derivatives. Examples of carriers that are useful in the bath of the present invention are the compounds disclosed and claimed in my U.S. Pat. No. 3,909,374.

A complexing agent such as $NH_4^+$, $K^+$ or $Na^+$ is added to the following examples:

EXAMPLE I

An acid zinc chloride bath of the following composition was prepared as an aqueous solution:

$ZnCl_2$—100 g/l
$NH_4Cl$—180 g/l
Sodium benzoate—4.1 g/l
Benzal acetone—0.2 g/l

EXAMPLE II

To the bath of Example I was added 6 g/l of a surfactant comprising an ethylene-propylene polyether. The bath was carbon treated and filtered before use to remove impurities. A panel of cold rolled, low carbon steel was plated in a 267 ml. Hull Cell at a temperature of 22° C. and a current of 2½ amps for 30 minutes to produce a fully bright deposit. Mechanical agitation was used during plating. A complexing agent such as $NH_4^+$, $K^+$ or $Na^+$ was added in an amount of between 5 and 200 g/l to prevent premature precipitation of the zinc.

EXAMPLE III

To a portion of the bath of Example I was added a surfactant comprising a low molecular weight sulfonated propylene oxide-ethylene oxide block polymer. The panel was plated in a 267 ml. Hull Cell at a current of 2½ amps for 30 minutes using the same procedure as in Example II. A milky white haze developed after baking the panel at 180° C. for 15 minutes.

EXAMPLE IV

To another portion of the bath of Example I was added the following surfactant in varying amounts between 2.25 and 9 g/l:

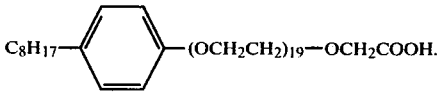

The plating procedures of Example II were followed. After baking at 180° C. for 15 minutes, the parts were examined and the following was observed: At 2.25 g/l, no blush was noted but there was a haze in the low current density range along with striations and blistering in the high current density area. At concentrations of 4.5 to 9 g/l, fully bright deposits were produced with no blistering. However, blush was noted in high current with no blistering. However, blush was noted in high current density areas between 7 and 10 amps per square decimeter.

EXAMPLE V

The surfactant used in Example IV was mixed with equal amounts of the following surfactant:

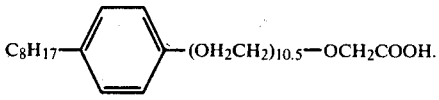

The total concentration of the surfactant in the bath was 4.5 g/l. When the steel panel was plated in a 267 ml. Hull Cell at 2½ amps for 30 minutes using mechanical agitation and was baked at 350° C. for 15 minutes, the panel was fully bright and no haze or blush was observed in the low, medium or high current density ranges.

EXAMPLE VI

In a preferred embodiment of the invention the plating bath is prepared by dissolving in water at 60° C. the following compounds:

$ZnCl_2$—83 g/l
KCl—225 g/l
$H_3BO_3$—20 g/l

The solution is cooled after which the remaining addition agents are mixed in the amounts specified:

Sodium benzoate or Sodium salicylate—4.1 g/l
Condensed naphthalene sulfonic acid—3.7 g/l to 6.9 g/l of a carboxy-terminated ethylene oxide adduct of a long chain alkyl phenol composed of a mixture of equal amounts of a lower molecular weight phenol having an average ethoxylation of 11.5 and a higher molecular weight phenol having an average ethoxylation of 19.
anti-pitter—1.9 g/l
Nicotinic acid—0.2 g/l
Benzal acetone—0.2 g/l During plating, the plating bath is agitated by mechanical means or with air. In addition to mixing the chemicals, the agitation permits plating at higher current densities without burning.

Proper surface preparation of the steel parts to be plated is essential for proper adhesion. This preparation typically consists sequentially of soaking in a strong cleaner followed by electrocleaning and an acid rinse, with one or more intermediate rinses in clear water.

The plating is carried out at a current density in the range of 3 to 4 amps per square decimeter and at a pH in the range of 5 to 5.2. The plating bath is maintained at room temperature, generally in the range of 20° C. to 17° C. During plating, the plating solution is preferably circulated through a filter at least once per hour for an air agitated bath and once every two hours for a mechanically agitated bath.

The plated part may be flexed without the noticeable formation of haze. Likewise, it may be coated with lacquer and heated to elevated temperatures without any haze development.

The present invention is not limited to the preceding examples and the parameters therein defined.

Instead, many other variations may be employed by the skilled artisan without departing from the inventive concept delineated by the claims in which I claim:

1. An aqueous acid zinc electroplating bath comprising
   A. a source of zinc ions,
   B. at least one organic brightening agent, and
   C. a surfactant to keep the brightening agent dispersed throughout the bath and consisting of a mixture of at least two carboxy-terminated ethylene oxide adducts of a long chain alkyl phenol having the general formula

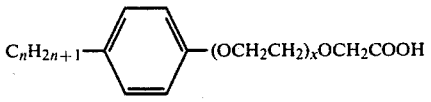

wherein one of the long chain alkyl phenols is present in an amount of between 30–70%, n is either 8 or 9, and in which x is between about 17 and about 21 and the second is present in an amount of between 70–30%, n is either 8 or 9, and x is between about 9 and about 12.

2. The bath according to claim 1 wherein the mixture of surfactants is present in an amount of between 5 and 25 g/l.

3. An acid zinc plating bath according to claim 1 wherein the mixture of surfactants is present in an amount to prevent the development of undesirable blush or haze when a zinc plated part is subjected to bending or to baking at elevated temperatures.

4. A process of producing deposits from an aqueous acid zinc electroplating bath wherein the deposits remain bright and free of blush and dulling when subjected to baking at elevated temperatures or to repeated bending, comprising using a non-haze producing surfactant comprising a mixture of at least two carboxy-terminated ethylene oxide adducts of a long chain alkyl phenols having the general formula

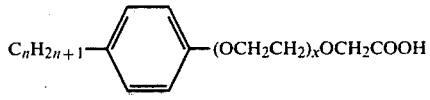

where n is either 8 or 9, x is between 9 and 12 in one of the phenols present in an amount of between 30 and 70% by weight of the mixture and x is between 17 and 21 in the other phenol present in an amount of between 70 and 30% by weight of the mixture of surfactants.

* * * * *